US005184165A

United States Patent [19]

Hauss

[11] Patent Number: 5,184,165

[45] Date of Patent: Feb. 2, 1993

[54] PROCESSOR WITH AUTOMATIC CHEMICAL DILUTION AND MIXING SYSTEM

[75] Inventor: Raymond G. Hauss, Rochester, N.Y.

[73] Assignee: Eastman Kodak Company, Rochester, N.Y.

[21] Appl. No.: 711,837

[22] Filed: Jun. 7, 1991

[51] Int. Cl.[5] ..... G03D 3/02

[52] U.S. Cl. ..... 354/324

[58] Field of Search ..... 354/324, 321-322, 354/298, 316, 317, 319, 320

[56] References Cited

U.S. PATENT DOCUMENTS

| | | | |
|---|---|---|---|
| 3,418,913 | 12/1968 | Snarr | 354/325 |
| 3,990,088 | 11/1976 | Takita | 354/324 |
| 4,329,042 | 5/1982 | Libicky et al. | 354/324 |
| 4,480,901 | 11/1984 | Osegowitsch et al. | 354/324 |
| 4,577,950 | 3/1986 | Mackson | 354/324 |
| 4,705,378 | 11/1987 | Miyaoka et al. | 354/324 |
| 4,769,662 | 9/1988 | Suzuki et al. | 354/324 |
| 4,804,990 | 2/1989 | Jessop | 354/324 |
| 4,806,962 | 2/1989 | Uchida et al. | 354/324 |
| 4,841,321 | 6/1989 | Kose et al. | 354/324 |
| 4,937,608 | 6/1990 | Ishikawa et al. | 354/324 |
| 4,942,416 | 7/1990 | Yoshimi | 354/324 |

FOREIGN PATENT DOCUMENTS

| | | | |
|---|---|---|---|
| 62-238559 | 10/1987 | Japan | 354/324 |
| 63-91661 | 4/1988 | Japan | 354/324 |
| 2-52343 | 2/1990 | Japan | 354/324 |

*Primary Examiner*—Michael L. Gellner
*Assistant Examiner*—D. Rutledge
*Attorney, Agent, or Firm*—Frank Pincelli

[57] ABSTRACT

A processor for photographic film or paper has a tank for holding a processing solution. A filter is located within the tank, and solution is removed from the tank through the filter and returned to the tank. An improved replenishment system for the processing solution includes a storage container for holding a concentrated replenishment solution. A pump delivers to the core of the filter a quantity of the concentrated replenishment solution. Water is provided to the filter core through a pressure regulator, a control valve and a fixed orifice. A microprocessor controls the pump and the control valve so that predetermined quantities of replenishment solution and water are simultaneously provided to the filter.

3 Claims, 1 Drawing Sheet

PROCESSOR WITH AUTOMATIC CHEMICAL DILUTION AND MIXING SYSTEM

BACKGROUND OF THE INVENTION

The present invention relates to processors for photographic film, paper or the like and, more particularly, to such a processor having a system for automatically diluting processing chemicals and for mixing such chemicals.

As known from U.S. Pat. No. 3,418,913, issued Dec. 31, 1968 in the name of J. L. Snarr, processors for a photographic medium have a plurality of tanks for holding processing solutions, including a developer solution and a fixer solution followed by a tank for water used for washing the photographic medium. The processing solutions in the tanks are recirculated by withdrawing the solution through a filter located within the tank and then pumping the solution through a heat exchanger and back into the tank. Replenishment solutions are provided through a replenishment line or conduit under the control of solenoid operated valves. The replenishment solution is provided downstream from the outlet of the tank and before the solutions reach the pump so that the replenishment solution is mixed with solution from the tank and cooled prior to being delivered to the tank with previously used solution.

The solutions used for processing photographic mediums are commonly supplied by the manufacturer in a concentrated form, and they are diluted with water before being supplied to the tanks of the processor. Dilution of the solutions commonly is accomplished manually by an operator. The dilution process requires the time of the operator, which increases the cost of the processing operation. Also, manual mixing of the concentrated processing materials and water is subject to error, which can have an adverse affect on the quality of the processing operation. In addition, premixing or dilution of the processing solutions can reduce the life of the solutions because the solutions are subject to evaporation and deterioration as a result of evaporation. The diluted processing solutions typically are contained within the film processor, and may occupy a substantial amount of space within the processor.

SUMMARY OF THE INVENTION

Accordingly, it is an object of the invention to provide an improved automatic chemical dilution and mixing system for a processor which eliminates the need for manual mixing of the processing solutions, increases the life of the solutions and reduces the space required in the processor for the processing solutions.

The present invention relates to an improvement in a processor for photographic film or paper, wherein the processor has a tank for holding a processing solution. A filter is at least partially located within the tank. Means are provided for removing solution from the tank through the filter and returning the solution to the tank. The improvement of the invention comprises a storage container for holding a concentrated replenishment solution. A suitable means, such as a pump, delivers to the filter a quantity of the concentrated replenishment solution. Also provided to the filter is a volume of water sufficient to dilute the concentrated solution.

The invention and its objects and advantages will become more apparent in the detailed description of the preferred embodiment of the invention presented below.

BRIEF DESCRIPTION OF THE DRAWINGS

In the detailed description of the preferred embodiment of the invention presented below, reference is made to the accompanying drawing, wherein FIG. 1 schematically illustrates an improved system for replenishing a processing solution in accordance with the present invention.

DETAILED DESCRIPTION OF THE PREFERRED EMBODIMENT

Figure 1:
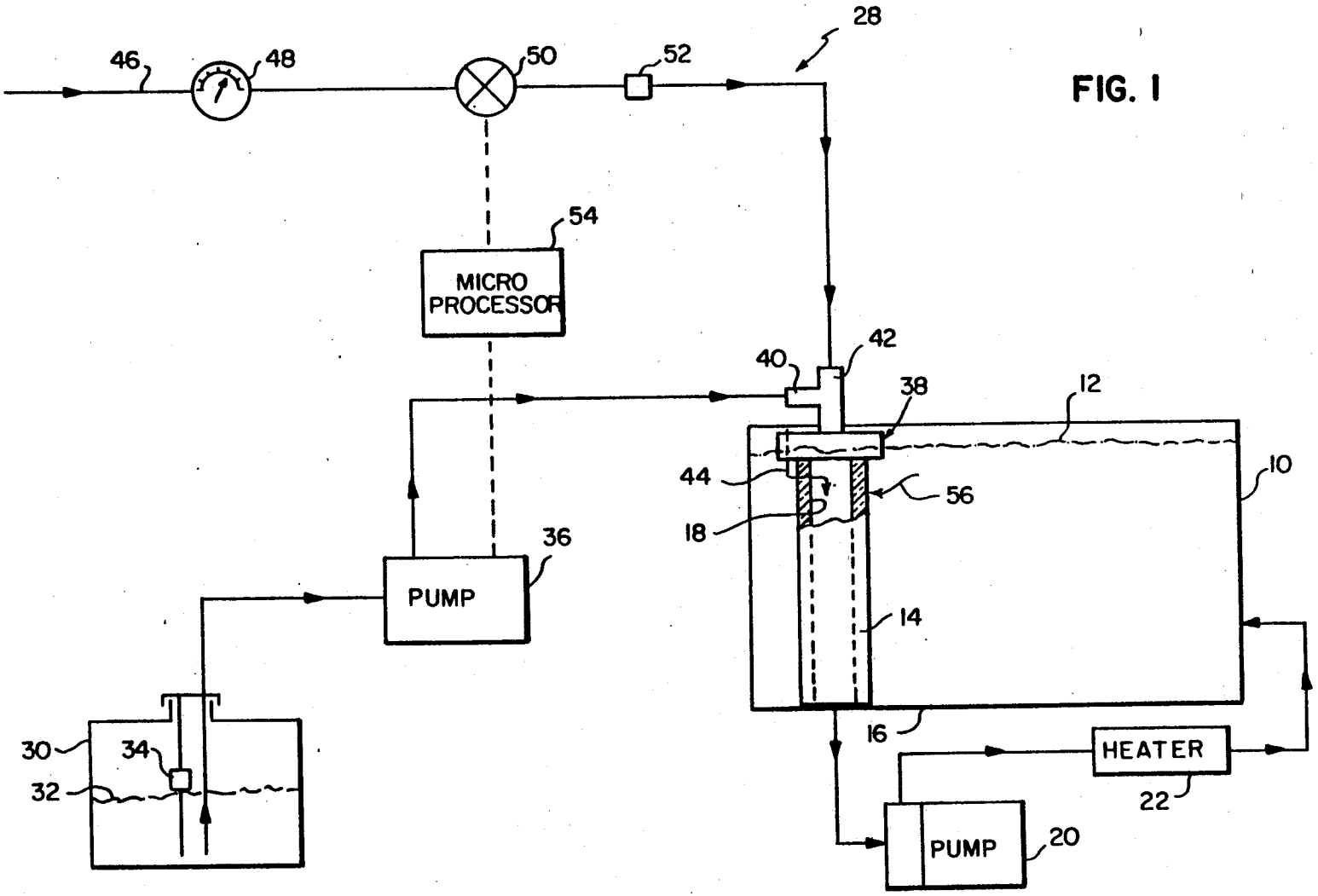

Processors for photographic media, such as film and paper, are well-known in the art. Therefore, only the portion of a conventional processor will be described, which is necessary to understand the automatic chemical dilution and mixing system of the invention. Also, while processors typically comprise several tanks for holding processing solutions, such as developer solution and fixer solution, only a single processing tank will be shown and described since the system of the invention can be used with solutions of developer, fixer, etc.

Referring now to FIG. 1 in detail, a processor for photographic film or paper has a tank 10 for holding a processing solution 12. A filter 14 is provided within the tank 10 and extends from a bottom wall 16 of the tank upwardly to the top of the solution 12 in the tank. Preferably, the filter 14 is of a generally cylindrical configuration having a hollow core 18. A recirculating pump 20 is connected to the bottom 16 of the tank so that it can withdraw fluid from the tank. The pump is connected so that fluid is withdrawn from the tank through the filter and then through the core 18 of the filter. Pump 20 delivers the processing solution through a heat exchanger, such as a heater 22, and returns the heated solution to the tank 10. Processors having tanks with systems for filtering and recirculating developing solutions, as described above, are known and need not be described in more detail here.

A preferred embodiment of the system of the invention for automatically diluting and mixing a processing solution is generally designated 28. The system comprises a storage container 30 for holding a quantity of concentrated replenishment solution 32. The solution 32 needs to be diluted before it is provided to the tank 10. Container 30 can be located within the film processor and, because the container holds concentrated solutions instead of diluted solutions, it takes up a relatively small space within the processor. Container 30 can be a container received from a supplier of such solutions, or it can be a container provided with the processor which is filled with concentrated solutions furnished in separate containers (not shown). When container 30 is to be filled from separate containers, a liquid level sensor 34 preferably is provided and connected to a suitable indicator visible from the exterior of the processor to alert the operator to the need to add additional concentrate to the container 30.

A metering pump 36 has its inlet or suction side connected by a conduit shown diagrammatically in FIG. 1 to the container 30 so that operation of the pump 36 is effective to withdraw concentrated processing solution from the container. The pump delivers a predetermined volume of solution per unit of time. Preferably, pump 36 is a bellows pump.

A cap 38 is positioned over the top of filter 14. The top of the cap 38 has two ports 40,42 through which fluids can be delivered into the cap. The cap has perforations located radially outwardly of the filter so that fluids delivered to the cap flow downwardly into the solution 12 adjacent the outer surface of the filter, as shown by the arrow 44. There fluids are drawn through the filter into core 18. The outlet of pump 36 is connected to the port 40 of the filter cap. Thus, operation of metering pump 36 is effective to deliver to the processing solution 12 a measured quantity of the concentrated replenishment solution 32 in the container 30.

Water for diluting the concentrated replenishment solution is provided to the port 42 of filter cap 38. More specifically, a water line diagrammatically shown at 46 is connected to a water supply and to a pressure regulator 48. The pressure regulator is effective to control the pressure of the water downstream of the regulator at a constant water pressure. A solenoid operated valve 50 is located downstream of the regulator 48. Valve 50 is a two-way solenoid valve that is opened to enable the water to flow from the regulator to a fixed orifice 52 in the water line. The orifice, in turn, is connected to the port 42 of the filter cap. Supplying of water through a regulator 48 and a fixed orifice 52 permits a consistent and determinable volume of water to be supplied per unit of time through the conduit to the port 42.

Control of the system of the invention can be effected in various ways. For example, a microprocessor 54 can be provided for the system, or the microprocessor can be part of a conventional film processor. The microprocessor is connected to the pump 36 and the solenoid valve 50 as shown by dotted lines in FIG. 1. The microprocessor is programmed to selectively operate the pump 36 and open the valve 50 to provide the desired quantities or volumes of concentrated processing solution from container 30 and water from line 46 to the filter cap, where they then flow into the solution and then through the filter into the hollow core 18 of the filter. By way of example, this can be accomplished by regulating the time the water valve is open and the bellows pump is operated. The microprocessor can determine when replenishment is required, based on various known parameters, such as the quantity of film processed, the number of sheets processed, etc.

Operation will now be described. When the pump 20 is activated, processing fluid 12 from tank 10 is drawn through the filter as shown by arrow 56 into the hollow core 18 of the filter. This processing solution travels through pump 20 and the heat exchanger 22 and is returned to the tank 10.

When replenishment of the processing solution is desired, the system 28 is activated through the microprocessor 54. The microprocessor is effective to turn on the pump 36 and to open the valve 50 for a predetermined time sufficient to deliver a specified volume of concentrated solution 32 and water to the ports 40,42, respectively, of the filter cap. The desired volume of water can be obtained by the system of the invention simply by the use of a pressure regulator, solenoid valve and fixed orifice without the need to measure the quantity or volume of liquid as required in some prior systems. The replenishment solution and water are delivered directly to the solution 12 adjacent filter 14, and then are drawn through the filter into the core 18 of the filter. As this occurs, they are mixed with each other and with used processing solution passing through the filter, as shown by arrow 56. This mixing of the solutions together continues as they pass through the pump 20 and heat exchanger 22 on the way to the tank 10. By the time the solution reaches the tank 10, the new and old processing solutions are thoroughly mixed and the new solution has been heated to the proper temperature by the heat exchanger 22.

A number of benefits are achieved by the system of the present invention. Manual mixing of concentrated replenishment solution and water is completely eliminated, thus simplifying the tasks of the operator, reducing costs, and assuring consistency in quality of the diluted replenishment solutions. Dilution of the concentrated replenishment solution occurs on board the processor instead of at a remote site or at a tank within the processor. Also, the container 30 can be smaller than required for diluted replenishment solutions, thus reducing the size of the processor or providing additional space inside the processor for other components. By retaining the solution 32 in a concentrated form until it is ready for use, the replenishment solution has a longer life compared to replenishment systems which require the replenishment solutions to be diluted before they are furnished to the processor.

The invention has been described in detail with particular reference to a preferred embodiment thereof, but it will be understood that variations and modifications can be effected within the spirit and scope of the invention.

I claim:

1. In a processor for photographic film or paper, the processor having a tank for holding a processing solution, a filter at least partially located within the tank, and means for removing processing solution from the tank through the filter and returning the processing solution to the tank, an improved system for replenishing the processing solution comprising:

a storage container for holding a concentrated replenishment solution, means for delivering to the processing solution adjacent the filter a quantity of the concentrated replenishment solution so that the concentrated replenishment solution is drawn directly into the filter, and means for providing to the processing solution adjacent the filter a quantity of water sufficient so that the quantity of water is drawn directly into the filter to dilute the concentrated solution.

2. The invention as set forth in claim 1, further comprising means for controlling the delivering means and the providing means so that replenishment solution and water are simultaneously provided to the processing solution.

3. In a processor for photographic film or paper, the processor having a tank for holding a processing solution, a filter at least partially located within the tank, the filter having a hollow core, and means for removing processing solution from the tank through the core of the filter and returning the processing solution to the tank, an improved system for replenishing the processing solution comprising:

a metering pump connected to the tank for delivering to the processing solution adjacent an outer surface of the filter a predetermined quantity of a concentrated replenishment solution, means for providing a quantity of water from a water supply to the processing solution adjacent an outer surface of the filter, the quantity of water being sufficient to diluter the concentrated replenishment solution, the providing means comprising a pressure regulator for controlling the pressure of water delivered from the water supply, a fixed orifice between the pressure regulator and the filter core, and a control valve between the pressure regulator and the fixed orifice to a control the flow of water to the fixed orifice and to the filter, and a microprocessor for controlling the metering pump means and the control valve so that replenishment solution and water are simultaneously provided to the filter.

* * * * *